United States Patent [19]

Yamaguchi et al.

[11] Patent Number: 5,057,369

[45] Date of Patent: Oct. 15, 1991

[54] HEATSETTABLE ARTIFICIAL HAIR AND PRODUCTION THEREOF

[75] Inventors: Shinji Yamaguchi; Katsura Maeda, both of Kurashiki; Masami Ohta, Takatsuki; Masao Kawamoto, Kurashiki, all of Japan

[73] Assignee: Kuraray Co., Ltd., Kurashiki, Japan

[21] Appl. No.: 436,632

[22] Filed: Nov. 15, 1989

[30] Foreign Application Priority Data

Nov. 21, 1988 [JP] Japan ..... 63-295119

[51] Int. Cl.[5] ..... D02G 3/00

[52] U.S. Cl. ..... 428/400; 132/53; 428/364; 428/372; 428/373; 428/395

[58] Field of Search ..... 428/364, 400, 373, 395, 428/372, 375; 132/53

[56] References Cited

U.S. PATENT DOCUMENTS

| | | | |
|---|---|---|---|
| 3,984,600 | 10/1976 | Kawase et al. | 428/395 X |
| 4,613,664 | 9/1986 | Tate et al. | 528/274 |
| 4,742,151 | 5/1988 | Tate et al. | 528/308.1 |
| 4,916,013 | 4/1990 | Maeda et al. | 428/400 X |
| 4,917,950 | 4/1990 | Wang | 428/401 |

*Primary Examiner*—Lorraine T. Kendall

*Attorney, Agent, or Firm*—Oblon, Spivak, McClelland, Maier & Neustadt

[57] ABSTRACT

Provided is an artificial hair made of a copolyester comprising polyethylene terephthalate copolymerized with an improving compound represented by

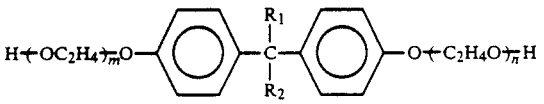

(1)

in an amount of 1 to 8 mol %, which can be headset for giving shapes such as curls or waves at a low temperature causing no migration or sublimation of disperse dyes, the shapes thus given being kept stably.

Also provided is a process for producing such artificial hair, which can by employment of specific techniques keep the dry heat shrinkage at 170° C. of the obtained artificial hair below 10%. Then the resulting artificial hair exhibits good operatability of the heatsetting procedure.

4 Claims, No Drawings

HEATSETTABLE ARTIFICIAL HAIR AND PRODUCTION THEREOF

BACKGROUND OF THE INVENTION

1. Field of the Invention

The present invention relates to polyester-based artificial hairs, which can be heatset to curl or wave at low temperatures causing no sublimation or migration of disperse dyes and keeps well the shape thus heatset and to the process for producing the same.

2. Description of the Prior Art

Commercial artificial hairs used for wigs and toupees made principally of synthetic fibers have various drawbacks. For example, modacryl fiber and polyvinyl chloride fiber have low strength and hence readily break when combed after they have been waved. Furthermore, their most serious drawback is that the curl or wave of them will be lost under such conditions as ordinary bath, hot shower, sauna and sports in the sunshine, thereby clearly disclosing the fact that they are artificial hairs. In other words, they are poor in durability of the shapes once heatset, resulting in ready deformation of the shape under the above conditions.

Application of polyethylene terephthalate (hereinafter referred to as PET) has been attempted for improving the durability of the heatset shapes, with some success, and artificial hairs of PET are now commercially available to some extent.

PET fibers are in most cases dyed with disperse dyes, with some being dope-dyed though. Most of wigs and toupees utilizing artificial hair are used in the form of mixture of groups of multiplicity of filaments, which groups have different colors or color shades. Such mixture is wrapped several times around a steel pipe and heatset in an oven at 180 to 200° C. for at least 10 minutes, or wrapped around a curing iron and then heatset. At this time, troubles often occur by the sublimation and migration of the disperse dyes on the filaments causing soiling or color change. This is caused by the fact that conventional PET fiber must be heatset at high temperatures. Against these troubles, the heatsetting may be conducted at a lower temperature with a prolonged setting time. Then, both the durability of heatset shape and prevention of migration of disperse dye can to some extent be achieved but with unavoidable increase in setting cost and shortage in the durability of the shapes heatset.

The heatset temprature of polyester fiber is decreased by copolymerization to decrease its melting point and/or glass transition temperature, which method is known to be applicable to conventional polyester fibers such as those for clothing use. Thus, polyester fibers are modified by such acid component as isophthalic acid, sodium 5-sulfoisophthalate, adipic acid, azelaic acid, malonic acid or succinic acid; or by such glycol component as butanediol, triethylene glycol, hexanediol, cyclohexanedimethanol, diethylene glycol, neopentyl glycol or nonanediol.

However, although in the polyesters modified by copolymerization of the above-mentioned component the melting point and/or glass transition temperature can be decreased to the desired level by controlling the copolymerization ratio so that they can be heatset more easily, it has been found that artificial hair filaments made from such polymers still have a drawback of readily destroying their once formed curls or waves by combing or brushing, in other words being inferior in the stability and durability of the heatset shapes. Such inferiority in the shape keeping performance after heatsetting may be attributed to the fact that both the above-mentioned acid components and glycol components have the function of increasing the number of bendings in the molecules of the polyesters.

Accordingly, an object of the present invention is to provide a polyester artificial hair which can readily be formed into curls or waves by using an iron or hot-air dryer and which assures excellent durability of the shapes thus formed over a long period of use.

Another object of the present invention is to provide a process for producing such an artificial hair.

SUMMARY OF THE INVENTION

The present inventors studied to obtain an optimal composition of the polyester used for artificial hair, for achieving the above object and found that the decrease in heatset temperature and the excellent durability of the once formed shapes can be achieved by modifying polyester with an amount of 1 to 8 mol% of a comparatively rigid unit of a compound represented by ethylene oxide adduct of 2,2-bis(4-hydroxyphenyl)propane (bisphenol), which is represented by the following general formula

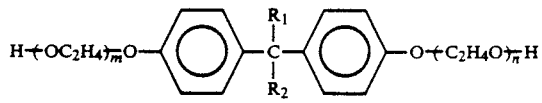

wherein $R_1$ and $R_2$ each is a hydrogen atom or a methyl group, and m and n each is an integer of 1 or 2.

It however was found that fibers comprising the above copolyester tend to have a high thermal shrinkage, which is inherent to copolyesters, and have drawbacks of generating minute stickings among the filaments when heated with an iron, being poor in slippage on an iron to increase slippage resistance, which drawbacks must be eliminated for the purpose of obtaining a usable artificial hair.

The migration and sublimation of disperse dye can be prevented by keeping the dyeing temperature at preferably 150 to 160° C. and at highest 170° C. Then, it has been found that the above drawbacks, including poor slippage, can be eliminated by keeping the thermal shrinkage at 170° C. [hereinafter abbriviated as "DSr (170)"] of such copolyester fibers at not more than 10%. Otherwise, that is, if a copolyester fiber has a DSr (170) exceeding 10%, it would shrink too much on an hot iron pipe or an iron for forming curl, thereby causing maloperatability of setting curl or waving, and generate stickings.

Accordingly, the present invention provides an artificial hair made of a synthetic fiber comprising a copolyester comprising ethylene terephthalate residue in an amount of at least 80 mol% of the total constituting units copolymerized with a compound represented by the following general formula (1) in an amount of 1 to 8 mol% of the total constituting units

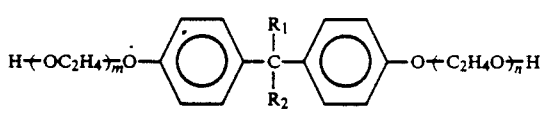

(1)

wherein $R_1$ and $R_2$ each is a hydrogen atom or a methyl group, and m and n each is an integer of 1 or 2, said fiber having a thermal shrinkage when heated at 170° C., DSr (170), calculated from the following formula of not more than 10%

$$DSr\,(170) = \frac{l_0 - l_1}{l_0} \times 100\,(\%)$$

wherein $l_0$ is the gauge length of a specimen filament under a load of 0.1 g/d before heat treatment and $l_1$ is the length measured under a load of 0.1 g/d after heat treatment in an oven at 170° C. for 10 minutes under a load of 1 mg/d followed by cooling.

The present invention further provides a process for producing heatsettable artificial hairs which can readily be heatset, which comprises extruding into filaments a copolymer comprising ethylene terephthalate residue in an amount of at least 80 mol% of the total constituting units copolymerized with a compound represented by the following general formula (1) in an amount of 1 to 8 mol% of the total constituting units

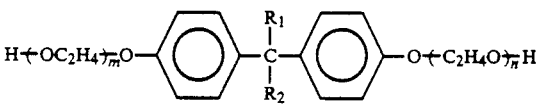

(1)

wherein $R_1$ and $R_2$ each is a hydrogen atom or a methyl group, and m and n each is an integer of 1 or 2; drawing the thus spun filaments and heat treating the drawn filaments while permitting them to relax and shrink.

DETAILED DESCRIPTION OF THE PREFERRED EMBODIMENT

The above-mentioned modifying component for polyester has been selected on the grounds that it can maintain the rigidity of the modified polyester while decreasing the melting point and/or glass transition temperature. In formula (1),m and n each is an integer of 1 or 2, and compounds with m=1 and n=1 are preferred. In this case compounds with m and/or n of 2 may also be present. Furthermore, compounds with m and/or n of 3 or more may also be present in an amount of not more than 10 mol%. $R_1$ and $R_2$ are preferably both methyl groups. The present invention employs copolyesters containing ethylene terephthalate residue in an amount of at least 80 mol%, preferably at least 90 mol%, and the residue of a compound represented by formula (1) in an amount of 1 to 8 mol%, preferably 2 to 6 mol%.

The above copolyesters are formed into filaments in such a way that they will have a DSr (170) of not more than 10%. Then, the filaments will, when used for artificial hair, produce effects of maintaining their shape and durability when the artificial hair is worn. The artificial hair can sufficiently be curled at 170° C. or 160° C. which temperature never causes soiling with disperse dye by sublimation and migration, and thus exhibit, in particular, excellent curl-settability.

The copolyester filaments having a DSr (170) of not more than 10%, preferably not more than 5%, can be produced by, besides keeping the copolymerization ratio of the compound of formula (1) at 8 mol% or below, subjecting the spun and drawn filaments to heat relaxation and shrinkage treatment. The heat relaxation and shrinkage treatment may be conducted either just after heat drawing process, or during or after dyeing process. Where the heat treatment is conducted just after heat drawing, it may be sufficient to give there a shrinkage of 5 to 10% to the filaments drawn, which treatment will produce effect of decreasing DSr (170) while maintaining straightness of filaments. Where the heat treatment is conducted during dyeing process, hank dyeing is preferred, which can dye without giving any tension to the filaments, for example with high-pressure Smith dyeing machine. When dyeing is conducted on cheeses or muffs, the relaxation and shrinkage can be given by employing soft-package utilizing a crushable core. Further where the filaments of tow-form are packed in a basket-type carrier and then dyed, resetting may be required after the dyeing to secure straightness of the filaments. In this case the tension at the resetting should be carefully selected, since too high a tension will increase the DSr (170) again over 10%.

As described hereinabove, the polyester-based artificial hair of the present invention is characterized by combination of the two techiques, one being employment of copolyester comprising ethylene terephthalate residue and a specific amount of a specific modifying agent and the other being application of a specific process when the copolyester is formed into filaments. As such, the obtained artificial hair can readily be curled or waved by heatsetting, and moreover, high stability of the shapes thus set and good operatability of the heatsetting are secured.

Illustrated next is a techique for further bringing the polyester-based artificial hair close to natural hair and, at the same time further enhancing the operatability at the dressing of the artificial hair, which technique can, in combination with the techniques described above, give still better polyester artificial hair.

Since PET filaments have high surface refractivity to give high reflection on their surface, they tend to show a glittering luster in the direct sunshine. It is therefore preferred that the surface of the PET filaments be roughened for the purpose of minimizing such glittering luster of PET filaments so that they will show no difference in the luster from, and thus be very similar to, natural hair. With respect to the degree of roughening, which can be observed with a scanning electronic microscope, it is preferred that the average distance of the adjacent projections or concaves be 0.1 to 1.5 μm and the density of the projections or concaves be 5 to 100 pieces per 10 μm of the circumferential length of a filament. If the average distance is less than 0.1 μm, the artificial hair will show unnatural glittering luster; and if the average distance exceeds 1.5 μm, the artificial hair will lose its luster. The effect of projections or concaves is not sufficiently produced with their density of less than 5 pieces per 10 μm of circumferential length, while a density of projections of not less than 100 pieces may again produce a glittering luster.

It is known to provide the surface of polyester fibers for clothing use with projections and concaves having a size of light wavelength order for the purpose of producing color deepening effect. It has now been found that, in the case of polyester-based artificial hair, its luster can be madé similar to that of natural hair by provision of projections and concaves having a size much larger than that in the case of producing color deepening effect for polyester fibers for clothing use. One of the reason for the above fact may be that polyester filaments for artificial hair are of much larger diameter than polyester fiber for clothing use, and further that a multiplicity of such coarse filaments having a large variation in fineness may, when bundled, produce an effect and function different from those of finer polyester fiber for clothing use.

The roughening of the surface of the copolyester filaments of the present invention can be achieved by a process which comprises incorporating inorganic particles having an average particle size of 1 μm or below into the copolyester at the time of polymerization or spinning, forming the polymer into filaments and then alkali-etching the thus obtained filaments. The number of particles present inside a filament increases with smaller average diameter of the particles and larger amount of the particles incorporated into the polymer, thereby reducing the amount, or loss, etched by alkali treatment required for the desired roughened surface, which is preferred from the viewpoint of economy. Accordingly, the average diameter should be 1 μm or less, preferably 0.1 μm or less; and, then, an incorporation amount of at least 1 wt% will provide sufficiently roughened surface when alkali-etched to a weight reduction of only about 10%. Apart from the purpose of roughening the surface, addition of a third component, e.g. a pigment for dope dyeing and/or a delustering agent can further bring the appearance of the filaments still closer to that of natural hair, since otherwise the artificial hair simply provided with roughened filament surfaces will still show too bright a reddish or yellowish shade when seen in the sunlight. Examples of the delustering agent used are titanium dioxide, kaolin, talc, zinc sulfide, zinc oxide and the like.

With respect to the fineness of the artificial hair, it should be about 20 deniers for finer hair and about 75 deniers for coarser hair. For coarser hair, attention should be paid to secure the straightness of the filaments used therefor. If coarser filaments are rapidly and nonuniformly cooled after being extruded through a spinneret, which causes asymmetrical cooling, such filaments will, after being drawn, contain nonuniform orientation of molecules and hence develop curling and/or waving. The curls or waves thus produced of the filaments will restrict the dressability of the artificial hair made of such filaments, which is not preferred. It has been found that straight filaments can be obtained by employing a lowered spinning speed of preferably not higher than 800 m/min, more preferably not higher than 600 m/min. Even at a low spinning speed, rapid asymmetrical cooling with a cooling medium flowing only in one direction should be avoided either in air-cooling or in water-cooling. On the other hand, the filaments cannot be taken up with too low a spinning speed, being lower than the falling speed of as-extruded filaments. The falling speed of the extruded filaments varies depending on the melt viscosity of the polymer used but, the spinnability generally becomes worse, in the case of the copolyester of the present invention, at a spinning speed of lower than 100 m/min. It is thus preferred to take up at spinning at 100 m/min to 800 m/min.

The filaments thus spun can then be drawn in the usual ways, among which heat drawing, more specifically wet heat drawing through hot water, is preferred for enhancing the uniformity of the filaments. Then, the afore-described heat shrinkage treatment is preferably conducted after the drawing, since it will prevent generation of curling caused by nonuniform molecular orientation.

Further it is in practice necessary for artificial hair to be readily ironed for forming curls or waves and, as mentioned before, particularly important is the slipping property between an iron and the hair. The copolyester artificial hair of the present invention, the surface of which tends to soften, can significantly be improved in its ironing property or heatsettablity by addition of a heat-resistant slipping agent to the surface of the constituting filaments which improvement will further enhance the effect of the present invention.

preferred examples of the heat-resistant slipping agent are, in particular, a silicone slipping agent comprising a cyclic siloxane having dissolved high molecular weight dimethylsiloxane and a silicone slipping agent comprising isoparaffine having dissolved or dispersed high molecular weight dimethylsiloxane. Modified silicones of water-dispersion type or water-solution type, or those of self-emulsifying type may also be used. Also used preferably for the purpose of decreasing resistance to friction are slipping agents based on fluoride or urethane; nonionic slipping agents containing polyalkylene glycol having emulsified a fat, wax or mineral oil having many hydrophobic groups and a high melting point; cationic slipping agents such as dimethylammonium distearyl chloride; and usable anionic slipping agents such as aliphatic alcohols reacted with sulfuric acid, sulfonated aliphatic alcohols, and like aliphatic acid condensates. These slipping agents may be used either alone or in combination such that the resistance to friction of the obtained filament measured at 170° C. will be 15 g or below, which characteristic has been found to improve the ironing property significantly.

The characteristic, resistance to friction, of filaments for artificial hair herein is measured as follows. An iron pipe for heatsetting having an outer diameter of about 1.5 to 2 cm (generally chrome-plated and mirror-finished) is electrically heated to a temperature of 170±3° C. and kept at the temperature. A specimen filament is wrapped around the pipe to a contacting angle of 360°, and loaded with a static load of 2 g at one end while the other end is clamped with the chuck connected to the strain gauge of a tensile testor such as Instron. The pipe is, while being mounted horizontal with the crosshead, brought down at a rate of 20 cm/sec by a distance of 10 cm. The reading is recorded, and an average of 10 repeated tests is defined as the resistance to slippage of the artificial hair between the iron pipe for heatsetting.

Surface roughening of the filaments is conducted by alkali etching either before or after dyeing. A slipping agent is applied after the surface roughening. The above-mentioned heat-resistant slipping agents are not particularly required at this stage and conventional slipping agents will do. However, the slipping agents of the aforementioned heat-resistant type will, if present at the time of curling with hot iron, reduce the resistance to slippage and thus markedly improve the dressability of the artificial hair. The heat-resistant slipping agents used may contain an antistatic agent, as in the cases of conventional hair dressing agents and textile finishing agents.

Other features of the invention will become apparent in the course of the following descriptions of exemplary embodiments which are given for illustration of the invention and are not intended to be limiting thereof.

EXAMPLES

Example 1

Copolymers were prepared from a mixed slurry of ethylene glycol containing silica particles and high-purity terephthalic acid (TpA) by direct polymerization with 400 ppm of a polymerization catalyst of antimonium oxide ($Sb_2O_3$), an improving agent being added after completion of esterification to further promote polymerization. Used as the improving agent was a compound of the afore-described formula (1) wherein $R_1$ and $R_2$ are each methyl group and the average $n \approx m \approx 1$, containing none with $m=0$ and/or $n=0$, to give copolymers comprising polyethylene terephthalate copolymerized with the improving agent in amounts of 1, 2, 4, 8 and 10 mol% ($[\eta]=0.68$ to 0.71).

The thus obtained polymers were each added with an amount of silica and then formed into filaments. As controls for comparison, PET without the improving agent, and copolyesters copolymerized with 4 and 8 mol% of isophtahlic acid each added with silica in the same amount as above were also formed into filaments. The filament formation was conducted as follows.

Chips of the copolymer were dried in the usual way and then melt and extruded through a spinneret having cocoon-shaped nozzles. The extruded filaments were cooled by air blown from around them by cylindrical cooling system, and taken up at 300 m/min. The filaments were then drawn through a water bath at 75° C. and thereafter shrunk in a hot water bath at 98° C. by 7% to give a bundle of filaments having an average fineness of 38 deniers. The bundles thus obtained were gathered into a hank with a total fineness of 1.5 million deniers, and the hank was alkali etched to a weight reduction of 10% and dyed in a high pressure Smith Dyeing Machine.

Dyeing condition

| | |
|---|---|
| Kayalon Polyester Dark Brown* | 3% owf |
| Kayalon Polyester Black* | 0.5% |
| Kayalon Polyester Yellow* | 2% |
| Kayalon Polyester Green* | 1% |
| Ultraviolet absorber: Sumipor UL** | 3% |

60° C. → 135° C. × 60 minutes, Bath ratio: 20:1

Reduction washing

| | |
|---|---|
| Hydrosulphite | 1 g/l |
| NaOH | 1 g/l |
| Amiladin*** | 1 g/l |

40° C. → 80° C. × 20 minutes, Bath ratio: 20:1

-continued

*Available from Nippon Kayaku Co., Ltd.
**Available from Sumitomo Chemical Co., Ltd.
***Available from Dai-Ichi Kogyo Seiyaku Co., Ltd.

As Comparative Examples with no relaxation and shrinkage treatment, spinning was conducted for the copolyester copolymerized with 8 mol% of the above improving agent and for a copolyester copolymerized with 8 mol% of isophthalic acid. The obtained filament bundles as spun were each drawn through a water bath at 75° C. and further drawn in a hot water at 98° C. without heat shrinkage and wound up on a perforated metal bobbin to give a cheese. The average filament denier was about 35 deniers for both Comparative Examples. The cheese each was dyed under the same dyeing conditions as above except for the bath ratio.

Each of the artificial hairs thus dyed was treated with a conventional finishing agent and then wrapped around an iron pipe several times with a sheet of paper between each wrap. Several pieces of the thus wrapped iron pipe were prepared. The iron pipes with the artificial hairs were placed in ovens at 150° C., 160° C. and 170° C. for 15 minutes, allowed to cool and taken out of the ovens. The thus curled filament bundles were brushed and evaluated for the shape of waves. Besides, each of the filament bundles heatset in an oven at 170° C. was also planted on a wig base, and dressed. The wigs thus prepared were each worn and the wearer bathed in sauna. After the bathing, the wigs were again brushed and evaluated for the shape keeping property of waves. The results are shown in Table 1.

As apparent from Table 1, the artificial hairs of the present invention, which were obtained from copolymers comprising the improving agent represented by formula (1) in amounts ranging from 1 to 8 mol% and had a DSr (170) of less than 10%, were, since they contained no filament stickings and were opened readily, able to be brushed without requiring excessive brushing force or causing filament breakages, thereby permitting the wave shape to remain stably. On the other hand, as seen in Comparative Examples, artificial hairs obtained from copolymers comprising an improving agent different from that of the present invention were, although they had a DSr (170) of less than 10%, gave waves which could not remain stably, and thus they did not have a ready heatsettablity. Furthermore, with respect to the curl keeping property after bathing in sauna, the artificial hairs of the present invention, which were obtained from copolymers comprising the improving agent in amounts ranging from 1 to 8 mol% and had a DSr (170) of less than 10%, exhibited an excellent shape keeping property and thus showed clearly an effect of ready heatsettability.

TABLE 1

| | Relaxation shrinkage | DSr (170) % | After oven-setting: Brushability* 150° C. | 160° C. | 170° C. | Shape of wave** after brushing 150° C. | 160° C. | 170° C. | Shape of wave after sauna test |
|---|---|---|---|---|---|---|---|---|---|
| Present Invention: modified by copolym. 1 mol % | yes | 3.2 | ○ | ○ | ○ | Δ | ○~Δ | ○ | good |
| Present Invention: modified by copolym. 2 mol % | yes | 4.1 | ○ | ○ | ○ | ○ | ○ | ◎ | good |
| Present Invention: modified by copolym. | yes | 5.5 | ○ | ○ | ○ | ○ | ◎ | ◎ | good |

TABLE 1-continued

| | Relaxation shrinkage | DSr (170) % | After oven-setting: Brushability* 150° C. | 160° C. | 170° C. | Shape of wave** after brushing 150° C. | 160° C. | 170° C. | Shape of wave after sauna test |
|---|---|---|---|---|---|---|---|---|---|
| 4 mol % Present Invention: modified by copolym. | yes | 7.3 | ○ | ○ | ○~Δ | ○ | ○ | ○ | good |
| 8 mol % Comparative Example: copolym. 8 mol %, cheese-dyed | no | 16.8 | Δ | Δ | X | Δ | Δ | Δ | marginal |
| Comparative Example: copolym. 10 mol %, cheese-dyed | yes | 11.2 | Δ | Δ ~ X | X | X | Δ | X | bad |
| Comparative Example: isophthalic acid-copolym., 4 mol % | yes | 5.0 | ○ | ○ | ○ | X | Δ | Δ | marginal |
| Comparative Example: isophthalic acid-copolym., 8 mol % | yes | 6.8 | ○ | Δ | X | X | Δ | X | bad |
| Comparative Example: isophthalic acid-copolym, 8 mol % cheese-dyed | no | 15.7 | Δ | Δ~X | X | X | X | X | bad |
| Comparative Example: unmodified PET | yes | 1.6 | ○ | ○ | ○ | X | X | Δ | bad |

*Brushability
○: Readily brushable.
Δ : Brushable but with some scratches.
X : Fiber breakage occurs due to fiber-sticking.
**Shape of wave after brushing
◎ : Sufficient number of waves having a small radius of curvature remain.
○: Good shape of wave
Δ : Rough waves.
X : Only a small number of waves.

EXAMPLE 2

Copolymers were prepared from a mixed slurry of ethylene glycol (EG) containing colloidal silica having an average particle size of 0.08 μm in such an amount as to be 3 wt% based on the weight of the copolymer after polymerization, and high-purity terephthalic acid (TpA) by direct polymerization with 400 ppm of a polymerization catalyst of antimonium oxide ($Sb_2O_3$), an improving agent being added after completion of esterification to further promote polymerization. Used as the improving agent was a compound of formula (1) wherein $R_1$ and R2 are each methyl group and the average $n \approx m \approx 1$, containing none with $m=0$ and/or $n=0$, to give copolymers comprising polyethylene terephthalate copolymerized with the improving agent in amounts of 1, 2, 4, 8 and 10 mol% ($[\eta]=0.68$ to 0.71).

Chips each of the copolymers thus obtained were dried in the usual way and then melt and extruded through a spinneret having cocoon-shaped nozzles. The extruded filaments were cooled by air blown from around them by cylindrical cooling system, and taken up at 380 m/min. The bundles of the filaments were then drawn through a water bath at 75° C. and thereafter shrunk in a hot water bath at 98° C. by 10% to give bundles of filaments having an average fineness of 39 deniers. As a Comparative Example, one bundle of the drawn filaments obtained from the above copolymer with 1 mol% of the improving agent was taken up into a cheese. Each of the bundles thus obtained was gathered into a hank with a total fineness of 1.5 million deniers, and the hank was alkali etched to a weight reduction of 8% and died in a high pressure Smith Dyeing Machine under the same conditions as used in Example 1. The Comprative Example cheese was cheese-dyed so that the filaments after the dyeing still showed a high DSr (170).

Each of the artificial hairs thus dyed was treated with an emulsion containing 3 g/l of a nonionic slipping agent, Lipo Oil NT-6 available from Nikka Chemical Ind. Co. and 0.5 g/l of an amphoteric antistatic agent (Amipol AS, available from Ipposha Co.) dried and formed into a male wig. After being prepared, the wig each was soaped in the usual way and thereafter treated with a heat-resistant silicone-based slipping agent comprising a cyclic siloxane having dissolved 10% by weight of high molecular weight dimethylsiloxane. The wigs were then subjected to curl testing with an iron at 170° C. for 10 seconds. The thus curled wigs were brushed and evaluated by observation for the dressability and curl settability while being compared with male hair. The results are shown in Table 2.

As apparent from Table 2, the artificial hairs of the present invention, which were obtained from copolymers comprising the improving agent represented by formula (1) in amounts ranging from 1 to 8 mol% and had a DSr (170) of less than 10%, showed a resistance to slippage of not more than 15 g and exhibited an excellent dressability of giving curls by ironing. On the other hand, the artificial hair of Comparative Example which had not been heat-shrunk and had been cheese-dyed, having a DSr exceeding 10% showed a resistance to slippage exceeding 15 g and was of poor dressability and further of inferior shape keeping property.

TABLE 2

| Artificial hair | DSr (170) (%) | Wig dressing test: Slippage resistance (g) | Wig dressing test: Dressability | Shape* just after setting | Shape** retention after brushing |
|---|---|---|---|---|---|
| Present invention: modified by copolym. 1 mol % | 3.0 | 5.1 | good | ○ | ○ |
| Present invention: modified by copolym. 2 mol % | 4.4 | 6.6 | good | ○~◎ | ◎ |
| Present invention: modified by copolym. 4 mol % | 5.2 | 7.3 | good | ◎ | ◎ |
| Present invention: modified by copolym. 8 mol % | 7.9 | 10.8 | fairly good | ○~◎ | ○ |
| Comparative Example: modified by copolym. 1.0 mol % | 11.0 | 17.4 | bad | XX | XX |

*, **Evaluation for appearance: good ◎ > ○> Δ > X > X X bad

EXAMPLE 3

The improved copolymer with a copolymerization ratio of 4 mol% obtained in Example 2 was used to form bundles of filaments as spun by employing the same air cooling system, at spinning take-up speeds of 80, 120, 300, 600, 800 and 1,000 m/min. In the spinning, the rate of extrusion through the spinneret was so adjusted as to give a filament fineness after drawing of 35 to 45 deniers. The copolymers used for low-speed spinnings were previously subjected to solid phase polymerization to increase its viscosity, and then subjected to the filament formation. The bundles of the filaments thus spun were heat drawn, heat shrunk and gathered into hanks in the same manner as in Example 2. The hanks were alkali etched and dyed in the same manner as in Example 2, and then evaluated for the appearance (straightness), DSr (170) and openability. The term "openability" herein designates combability when the end extending about 5 cm of a bundle of filaments having a fineness of about 1.5 to 2 million deniers is crumpled in the palm of the hand for a few minutes and then combed. The results are shown in Table 3. In the table, [η] values are those measured in a mixed solvent of phenol/tetrachloroethan (1/1) at 30° C.

The openability was evaluated on the bundles of filaments previously treated with a 10% aqueous solution of a water-soluble silicone oil comprising silicone modified with polyether, KF-352 (A) available from Shin-etsu Chemical Co.

As apparent from Table 3, the filaments taken up at spinning at 800 m/min or more have low straightness and, even treated with a slipping agent, low openability and difficult to comb. On the other hand, the filament bundles taken up at the low rate range according to the present invention and applied with a slipping agent were able to be combed smoothly, with the exception of the bundle taken up at lower than 100 m/min, which could not be spun steadily.

TABLE 3

| Polymer and [η] | Spinning take-up speed m/min | Drawability at spinning | DSr (170) (%) | Appearance of filament bundle after being dyed (straightness) | Openability |
|---|---|---|---|---|---|
| Improved polymer 0.79 | 80 | bad | 4.9 | ◎ | ◎ |
| Improved polymer 0.76 | 120 | good | 5.3 | ◎ | ◎ |
| Improved polymer 0.68 | 300 | good | 5.4 | ◎ | ◎ |
| Improved polymer 0.68 | 600 | good | 6.2 | ○ | ◎ |
| Improved polymer 0.68 | 800 | fairly good | 6.1 | ○~Δ | ○~Δ |
| Improved polymer 0.68 | 1000 | marginal | 7.0 | X | Δ~X |

Straightness: good ◎ > ○> Δ > X bad: crimps develop
Openability: combability good ◎ > ○> Δ > X > X X bad

EXAMPLE 4

The improved copolyester (4 mol%-modified) used in Example 2 and PET were each extruded and taken up at 450 m/min to give a bundle of filaments as spun having a cocoon-shaped cross section. The bundles were 2-stage drawn in water baths and then dry-heat shrunk by 5% followed by constantlength heatsetting at 160° C. to give tows of 0.7 million deniers comprising heterofineness filaments having a fineness ranging from 32 to 49 deniers and 40 to 43 deniers in an average. The tows were wound into soft-package cakes, and the cakes were alkali etched to 8% weight reduction, neutralized, washed and then dyed to two levels of black color and two levels of gray color for grey hair use.

The cakes thus dyed were treated with a finishing solution containing 3 g/l of a nonionic surfactant (Lipo Oil NT-15, available from Nikka Chemical Ind. Co.) containing a high melting point wax and a small amount of a cationic slipping agent and 1 g/l of an antistatic agent (F-col, available from Matsumoto yushi-Seiyaku Co.).

The 2 black tows and 2 grey tows obtained above according to the present invention and those from PET were each mixed in equal amounts to give artificial hairs. The artificial hairs were each wrapped several times around a chrome-plated iron pipe having a diameter of 2 cm and heatset in ovens at 180, 170 and 160° C. for 10 minutes.

The artificial hair prepared above from PET showed, after being curled and heatset at 180° C., a good shape keeping property but, then, suffered serious soiling by migaration and sublimation of dye. That curled and heatset at 170° C. was somewhat improved in the soiling but became poor in shape keeping property, which tendency was still more pronounced with the heatsetting temperature of 160° C. Any suitable temperature range for heatsetting could thus not be found out for the PET artificial fiber. On the other hand, the artificial hair according to the present invention showed, after being heatset at 180° C., a definite soiling which however was not so pronounced as the PET artificial hair. The soiling was decreased with the heatsetting temperature of 170° C. and almost no soiling with 160° C., with which the shape was well set and its stability was good.

Thus the improvement of polyester clearly produced an effect of low temperature heatsettability. The mechanism of preventing migration soiling was studied. It was found that, while coarse PET filaments with fineness of 30 to 50 deniers can be dyed almost on their surface layer only and not into the core part of filaments, the improved copolyester filaments of the present invention can be dyed uniformly throughout the filament cross section, which fact helps preventing soiling by migration of dye.

Obviously, numerous modifications and variations of the present invention are possible in light of the above teachings. It is therefore to be understood that within the scope of the appended claims, the invention may be practiced otherwise than as specifically described herein.

What is claimed is:

1. A heatsettable artificial hair which can readily be heatset and is made of synthetic filaments comprising a copolyester comprising ethylene terephthalate residue in an amount of at least 80 mol% of the total constituting units copolymerized with a compound represented by the following general formula (1) in an amount of 1 to 8 mol% of the total constituting units

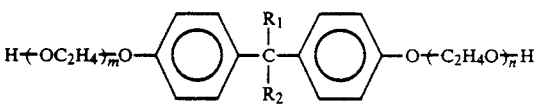

(1)

wherein $R_1$ and $R_2$ each is a hydrogen atom or a methyl group, and m and n each is an integer of 1 or 2, said filaments having a thermal shrinkage when heated at 170° C., DSr (170), calculated from the following formula of not more than 10%

$$DSr\,(170) = \frac{l_0 - l_1}{l_0} \times 100\,(\%)$$

wherein $l_0$ is the gauge length of a specimen filament under a load of 0.1 g/d before heat treatment and $l_1$ is the length measured under a load of 0.1 g/d after heat treatment in an oven at 170° C. for 10 minutes under a load of 1 mg/d followed by cooling.

2. A heatsettable artificial hair according to claim 1, wherein said synthetic filaments have a roughened surface.

3. A heatsettable artificial hair according to claim 1, having resistance to slippage on iron pipe of not more than 15 g/filament.

4. A heatsettable artificial hair according to claim 1, wherein a heat-resistant slipping agent is provided on the surface of said synthetic filaments.

* * * * *